US011655824B2

(12) United States Patent
Cote

(10) Patent No.: US 11,655,824 B2
(45) Date of Patent: May 23, 2023

(54) FAN MODULE INCLUDING COAXIAL COUNTER ROTATING FANS

(71) Applicant: Robert Bosch GmbH, Stuttgart (DE)

(72) Inventor: F. Raymond Cote, Dover, MA (US)

(73) Assignees: Robert Bosch LLC, Broadview, IL (US); Robert Bosch GmbH, Stuttgart (DE)

( * ) Notice: Subject to any disclaimer, the term of this patent is extended or adjusted under 35 U.S.C. 154(b) by 0 days.

(21) Appl. No.: 17/394,795

(22) Filed: Aug. 5, 2021

(65) Prior Publication Data

US 2022/0065259 A1 Mar. 3, 2022

Related U.S. Application Data

(60) Provisional application No. 63/070,366, filed on Aug. 26, 2020.

(51) Int. Cl.

| | |
|---|---|
| ***F04D 25/06*** | (2006.01) |
| ***F04D 25/16*** | (2006.01) |
| ***F04D 29/54*** | (2006.01) |
| ***F04D 19/00*** | (2006.01) |

(52) U.S. Cl.

CPC ..... *F04D 25/166* (2013.01); *F04D 19/002* (2013.01); *F04D 25/06* (2013.01); *F04D 29/541* (2013.01)

(58) Field of Classification Search

CPC .... F04D 19/007; F04D 25/166; F04D 29/563; F04D 29/541–542; F04D 29/544–545; F04D 29/547; F01P 2005/025; F01P 2005/046

USPC ..... 415/192–296

See application file for complete search history.

(56) References Cited

U.S. PATENT DOCUMENTS

| | | | | |
|---|---|---|---|---|
| 5,771,961 | A | 6/1998 | Alizadeh | |
| 5,931,640 | A | 3/1999 | Van Houten et al. | |
| 7,156,611 | B2 | 1/2007 | Oosawa et al. | |
| 2007/0264123 | A1* | 11/2007 | Yoshida | F04D 19/024 416/128 |
| 2009/0155104 | A1* | 6/2009 | Takeshita | F04D 19/007 415/199.5 |
| 2012/0213650 | A1* | 8/2012 | Lee | F04D 25/0633 417/423.7 |
| 2014/0363272 | A1 | 12/2014 | Kitamura et al. | |

FOREIGN PATENT DOCUMENTS

| | | |
|---|---|---|
| DE | D7322 M | 5/1952 |
| DE | 10109621 | 2/2001 |
| DE | 102007022663 | 12/2007 |

(Continued)

*Primary Examiner* — Thomas Fink

(74) *Attorney, Agent, or Firm* — Kelly McGlashen; Maginot, Moore & Beck LLP

(57) ABSTRACT

A fan module for a vehicle engine cooling system includes a pair of co-axial, counter-rotating, axial flow fans. Each fan is supported on and driven by a dedicated downstream motor, and each motor is supported by a dedicated shroud. The shroud that supports the first motor includes a barrel, a motor carrier that is surrounded by the barrel, and vanes that extend between the barrel and the motor carrier. For each vane, a line that extends between the vane nose and the vane tail is angled relative to the fan rotational axis, and the angle is selected to minimize air flow losses through the shroud.

15 Claims, 6 Drawing Sheets

(56) References Cited

FOREIGN PATENT DOCUMENTS

| | | | | | |
|---|---|---|---|---|---|
| DE | 102007022663 | A1 * | 12/2007 | ..... | F04D 19/007 |
| DE | 102019213315 | | 9/2019 | | |
| EP | 0499698 | | 8/1992 | | |
| EP | 1653087 | | 5/2006 | | |
| EP | 1764511 | | 3/2007 | | |
| EP | 2458223 | | 5/2012 | | |
| WO | WO-2015105202 | A1 * | 7/2015 | ..... | F04D 19/024 |

* cited by examiner

FAN MODULE INCLUDING COAXIAL COUNTER ROTATING FANS

BACKGROUND

In some vehicles, a cooling fan is used to cool the vehicle engine during vehicle operation. For example, the cooling fan may be placed downstream of a heat exchanger used to cool engine coolant, and the cooling fan draws air through the heat exchanger. In some vehicles, the cooling fan is driven by the vehicle engine. However, fuel economy requirements are resulting in a shift from engine-driven cooling fans to electric motor-driven cooling fans. Use of electric motor-driven cooling fans in larger vehicles may be limited by the power of available electric motors.

SUMMARY

A first approach for overcoming the motor power limit includes dividing the power requirements between two motors. A second approach for overcoming the motor power limit includes improving fan efficiency, e.g., obtaining more air power for same electrical power. In some aspects, a counter rotating fan module is provided that combines dividing the power requirements between two motors and providing improved fan efficiency. Advantageously, the counter rotating fan module includes two axial flow fans and two motors in a single fan module. In the fan module, the two fans and corresponding motors are installed in a compact space (compared with side-by-side fans).

The action of a fan creates an inherent loss of kinetic energy by introducing rotation (swirl) in the air leaving the fan. In the case of a single fan, the energy in the swirl component of the flow is dissipated without doing useful work. In the fan module, a second axial flow fan is placed downstream from the first axial flow fan with respect to the direction of air flow through the fan module so that the fans rotate about a rotational axis that is approximately common to both fans, and so that the fans are counter-rotating (e.g., the first fan and the second fan rotate in opposite directions). It is understood that, in use, the rotational axes of the first and second fans may not be precisely co-linear. In some embodiments, the term "approximately common" is used to indicate that the fan rotational axes are co-linear within twelve degrees of rotation and/or an offset of up to twelve percent of the downstream fan diameter, as measured between the intersections of the two fan rotation axes with a plane that passes through the forward-most portion of the hub of the second fan. In other embodiments, the term "approximately common" is used to indicate that the fan rotational axes are co-linear within six degrees of rotation and/or an offset of up to six percent of the downstream fan diameter. In still other embodiments, the term "approximately common" is used to indicate that the fan rotational axes are co-linear within three degrees of rotation and/or an offset of up to three percent of the downstream fan diameter. The first fan generates air flow through the fan module that includes axial and tangential flow components. The second fan has substantially the same diameter as the first fan, and is configured to remove the tangential flow component from the air flow through the fan module. As a result, the second fan recovers the energy from the swirl of the air flow leaving the upstream fan. Additionally, the fan module is configured so that the flow leaving the second fan has little or no swirl, whereby, there is no resulting loss of kinetic energy due to the swirl. As a result, the combination of the two counter-rotating fans can operate more efficiently than a single fan.

In the fan module, each axial flow fan is driven by a separate motor. Each motor is supported within a shroud by a dedicated motor carrier, and each fan is supported on a corresponding motor such that the fan is disposed upstream of the respective motor carrier.

Each shroud includes a barrel, the motor carrier that supports the respective motor, and spoke-like vanes that support the motor carrier within the barrel. The vanes are disposed in the path of the air flowing through the shroud. Each vane has a profile, and includes a leading end and a trailing end that is opposed to the leading end. In most cases, it is advantageous to minimize the effect of the vanes on the air flowing through the shroud. To this end, the shroud of the first axial flow fan includes vanes that are configured so that a line extending between the leading end and the trailing end is angled relative to the fan rotational axis. In some embodiments, the line is angled so as to align with the swirl of the first fan. In the shroud of the second axial flow fan, the vanes are aligned axially (e.g., parallel to the fan rotational axis).

In some aspects, a fan module for an automotive cooling system includes a first fan that is configured to rotate about a fan rotational axis and a second fan that is configured to rotate about a second axis. The second fan is disposed downstream of the first fan with respect to the direction of airflow through the fan module, and the second axis is approximately common with the fan rotational axis. The fan module includes a first motor configured to drive the first fan to rotate about the fan rotational axis in a first direction and a second motor configured to chive the second fan to rotate about the second axis in a second direction. The second direction is opposed to the first direction. The fan module includes a first shroud that supports the first motor. The first shroud includes a first barrel that surrounds the fan rotational axis, a first motor carrier that is disposed inwardly with respect, to the first barrel, and first vanes that extend between the first barrel and the first motor carrier. The fan module also includes a second shroud that supports the second motor. The second shroud includes a second barrel that surrounds the fan rotational axis, a second motor carrier that is disposed inwardly with respect to the second barrel, and second vanes that extend between the second barrel and the second motor carrier. The first motor is supported by the first motor carrier, the second motor is supported by the second motor carrier, the first motor carrier is disposed downstream from the first fan with respect to the direction of air flow through the fan module, and the second motor carrier is disposed downstream from the second fan with respect to the direction of air flow through the fan module. Each first vane has a first nose that faces the direction of air flow through the fan module, and a first tail that is opposed to the first nose. A first line that extends between the first nose and the first tail is angled at a first angle relative to the fan rotational axis. Each second vane has a second nose that faces the direction of air flow through the fan module, and a second tail that is opposed to the second nose. A second line that extends between the second nose and the second tail is angled at a second angle relative to the second axis. The second angle is different than the first angle.

In some embodiments, the first angle is aligned with air flow discharged from the first fan.

In some embodiments, the first angle is a non-zero angle.

In some embodiments, the second angle is approximately zero.

In some embodiments, the second line is parallel to the second axis.

In some embodiments, the fan module includes an air guide that supports the first shroud and is configured to provide an air flow passage between the first fan and a heat exchanger, and the second shroud is supported on the first shroud.

In some embodiments, the first shroud is integral with the air guide.

In some embodiments, the first vane includes opposed first air flow surfaces that extend between the first nose and the first tail, and the distance between the respective first air flow surfaces is small relative to a distance between the first nose and the first tail. In addition, the second vane includes opposed second air flow surfaces that extend between the second nose and the second tail, and the distance between the respective second air flow surfaces is small relative to a distance between the second nose and second tail.

In some aspects, an automotive cooling system comprising a heat exchanger and a fan module configured to draw air through the heat exchanger. The fan module includes a first fan that is configured to rotate about a fan rotational axis and a second fan that is configured to rotate about a second axis. The second fan is disposed downstream of the first fan with respect to the direction of airflow through the fan module, and the second axis is approximately common with the fan rotational axis. The fan module includes a first motor configured to drive the first fan to rotate about the fan rotational axis in a first direction, and a second motor configured to drive the second fan to rotate about the second axis in a second direction, where the second direction is opposed to the first direction. The fan module includes a first shroud that supports the first motor. The first shroud includes a first barrel that surrounds the fan rotational axis, a first motor carrier that is disposed inwardly with respect to the first barrel, and a first vane that extends between the first barrel and the first motor carrier. The fan module includes a second shroud that supports the second motor. The second shroud includes a second barrel that surrounds the fan rotational axis, a second motor carrier that is disposed inwardly with respect to the second barrel, and a second vane that extends between the second barrel and the second motor carrier. The first motor is supported by the first motor carrier, the second motor is supported by the second motor carrier, the first motor carrier is disposed downstream from the first fan with respect to the direction of air flow through the fan module, and the second motor carrier is disposed downstream from the second fan with respect to the direction of air flow through the fan module. The first vane has a first nose that faces the direction of air flow the fan module, and a first tail that is opposed to the first nose. A first line that extends between the first nose and the first tail is angled at a first angle relative to the fan rotational axis. The second vane has a second nose that faces the direction of air flow through the fan module, and a second tail that is opposed to the second nose. A second line that extends between the second nose and the second tail is angled at a second angle relative to the second axis. The second angle is different than the first angle.

In some embodiments, the first angle is aligned with air flow discharged from the first fan.

In some embodiments, the first angle is a non-zero angle.

In some embodiments, the second angle is approximately zero.

In some embodiments, the second line is parallel to the second axis.

In some embodiments, an air guide that supports the first shroud and is configured to provide an air flow passage between the first fan and a heat exchanger, and the second shroud is supported on the first shroud.

In some embodiments, the first shroud is integral with the air guide.

In some embodiments, the first vane includes opposed first air flow surfaces that extend between the first nose and the first tail, and the distance between the respective first air flow surfaces is small relative to a distance between the first nose and the first tail. In addition, the second vane includes opposed second air flow surfaces that extend between the second nose and the second tail, and the distance between the respective second air flow surfaces is small relative to a distance between the second nose and second tail.

In some aspects, a method of manufacturing a fan module for a vehicle is provided. The fan module includes a first fan, a first motor configured to drive the first fan to rotate about a fan rotational axis in a first direction, and a first shroud that supports the first motor relative to the first fan via a first motor carrier that is disposed downstream of the first fan with respect to the direction of air flow through the fan module. The fan module includes a second fan that is disposed downstream of the first fan with respect to the direction of airflow through the fan module, and a second motor configured to drive the second fan to rotate about a second axis in a second direction, where the second direction is opposed to the first direction and the second axis is approximately common with the fan rotational axis. The fan module includes a second shroud that supports the second motor relative to the second fan via a second motor carrier that is disposed downstream of the second fan with respect to the direction of air flow through the fan module. The method includes assembling a first subassembly that includes the first fan, the first shroud, the first motor carrier and the first motor, assembling a second subassembly that includes the second fan, the second shroud, the second motor carrier and the second motor, and assembling the first sub assembly with the second subassembly to provide a third subassembly in which the second fan is disposed downstream relative to the first fan with respect to a direction of air flow through the first fan.

In some embodiments, the fan module comprises an air guide, and the method includes assembling the third subassembly with the air guide.

In some embodiments, the hi some embodiments, the first shroud is integrally formed with an air guide, and the method step of assembling the first sub assembly with the second subassembly to provide a third subassembly includes securing the second subassembly to an end of the first shroud.

In some embodiments, the first shroud includes a first barrel that surrounds the fan rotational axis the first motor carrier that is disposed inwardly with respect to the first barrel, and first vanes that extend between the first barrel and the first motor carrier. In addition, the second Shroud includes a second barrel that surrounds the fan rotational axis, the second motor carrier that is disposed inwardly with respect to the second barrel, and second vanes that extend between the second barrel and the second motor carrier. Each first vane has a first nose that faces the direction of air flow exiting the first fan, and a first tail that is opposed to the first nose, and a first line that extends between the first nose and the first tail is angled at a first angle relative to the fan rotational axis. Each second vane has a second nose that faces the direction of air flow exiting the second fan, and a second tail that is opposed to the second nose, and a second line that extends between the second nose and the second tail is angled at a second angle relative to the second axis. The second angle is different than the first angle.

DETAILED DESCRIPTION

Figure 2:
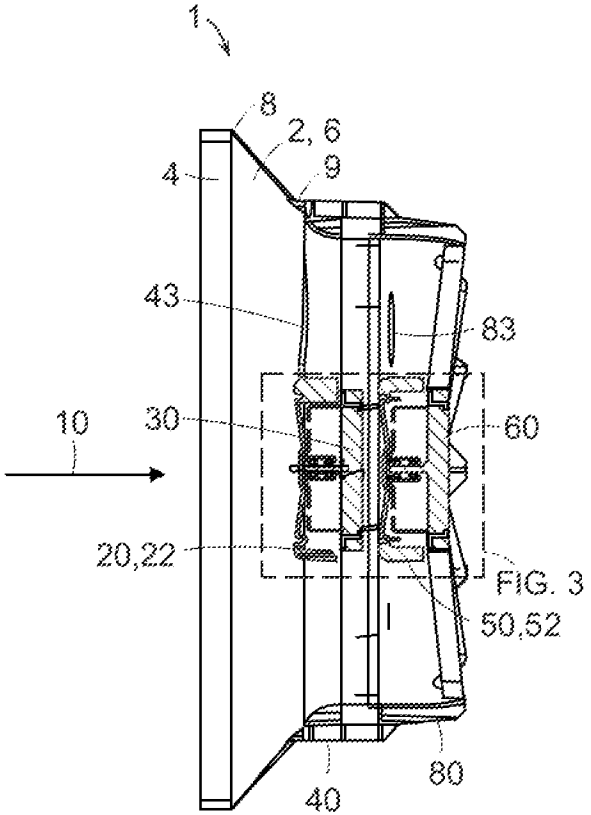
FIG. 2 is a side cross-sectional view of the fan module of FIG. 1 as seen along line 2-2 of FIG. 1.
Figure 1:
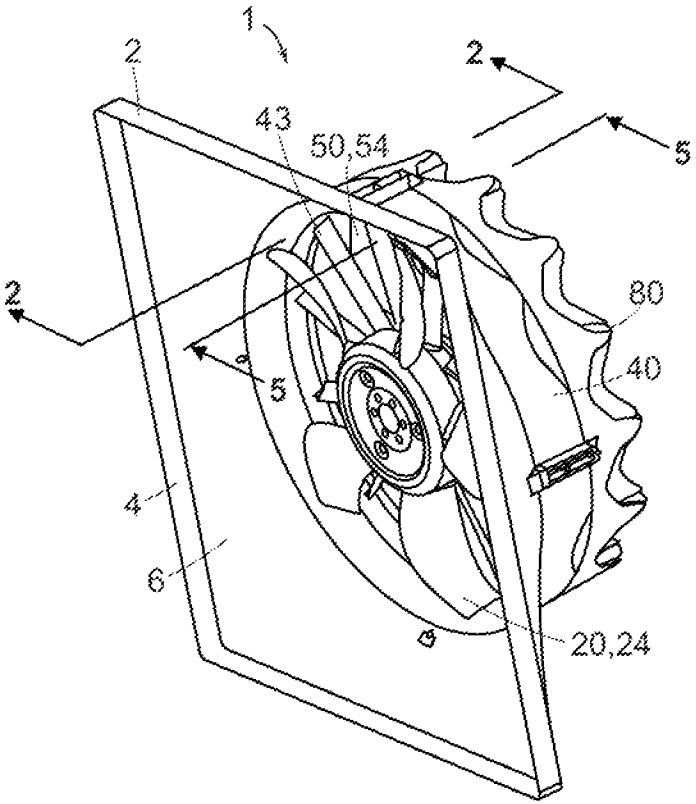
FIG. 1 is a perspective view of a fan module that includes two, co-axial, counter-rotating axial flow fans.
Figure 3:
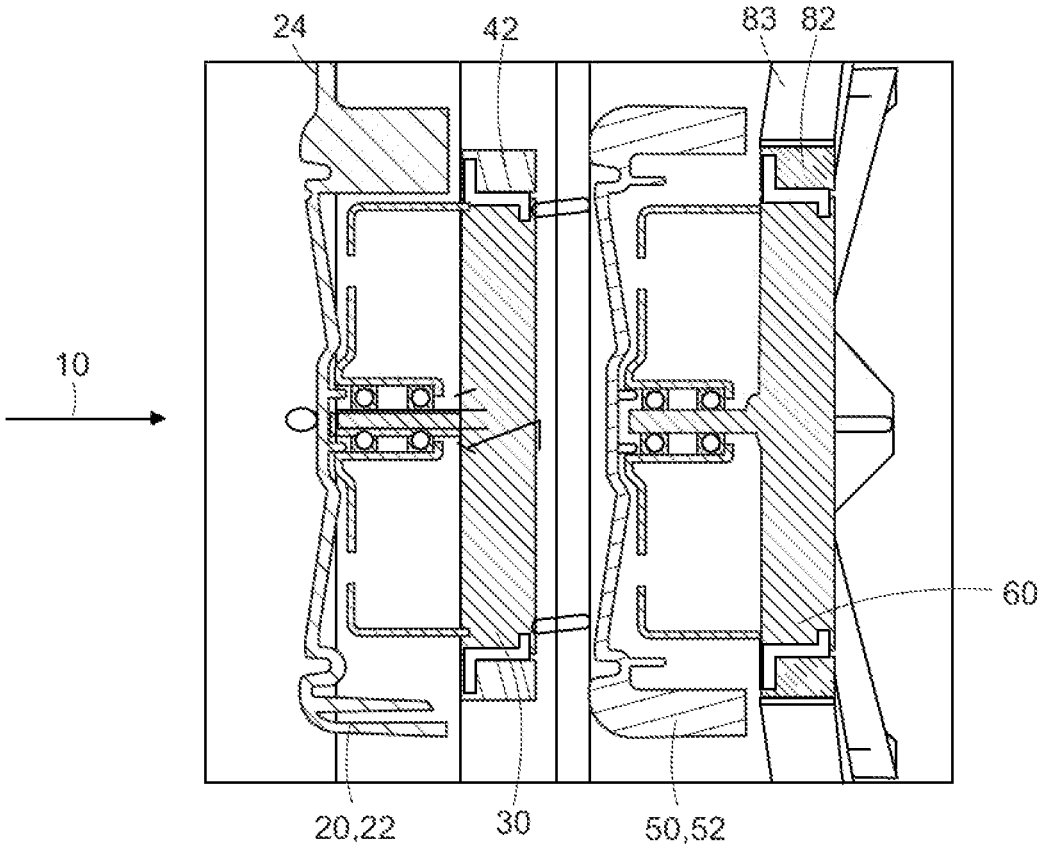
FIG. 3 is an enlarged view of a portion of FIG. 2 as indicated by the reference label "FIG. 3" in FIG. 2.
Figure 4:
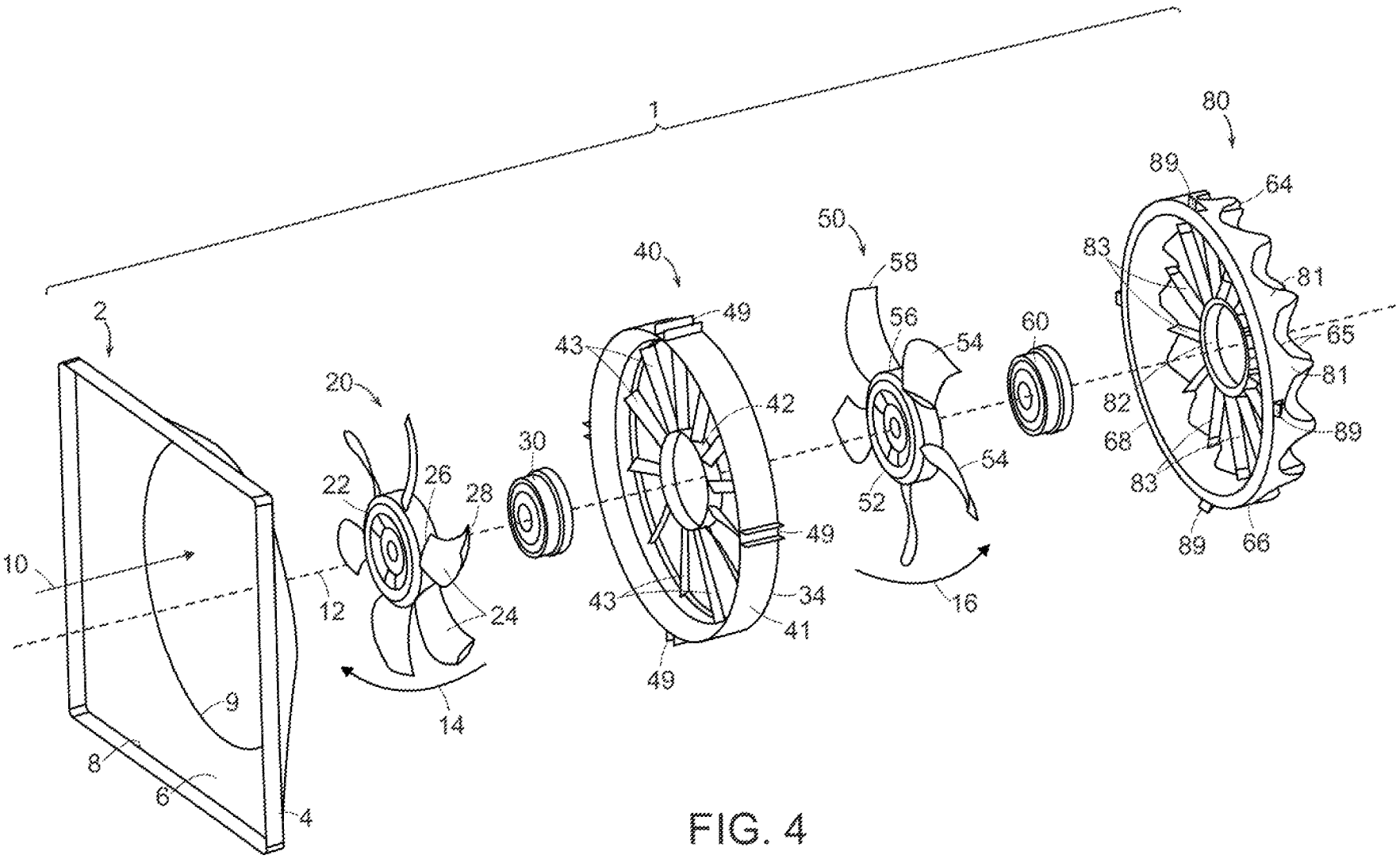
FIG. 4 is an exploded view of the fan module of FIG. 1.
Figure 5:
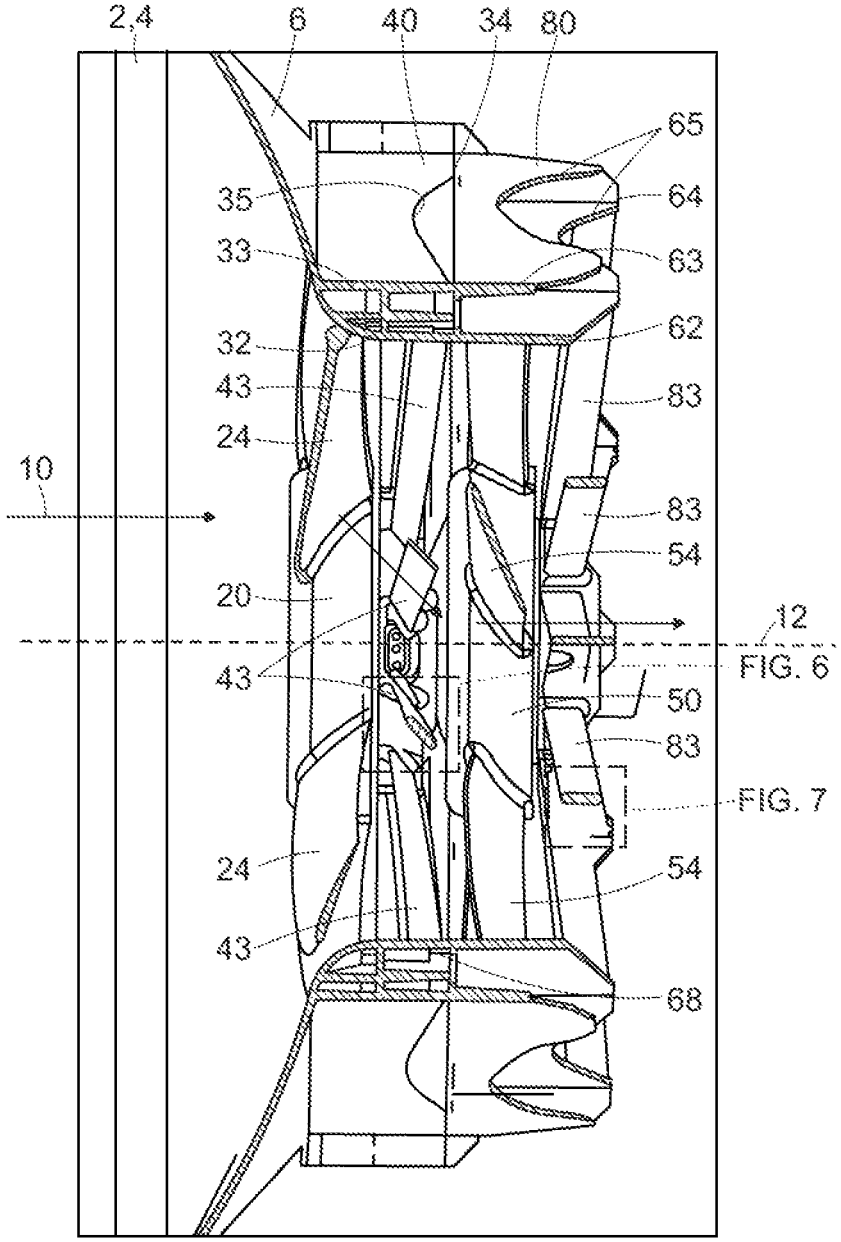
FIG. 5 is a side cross-sectional view of a portion of the fan module of FIG. 1 as seen along line 5-5 of FIG. 1.
Figure 6:
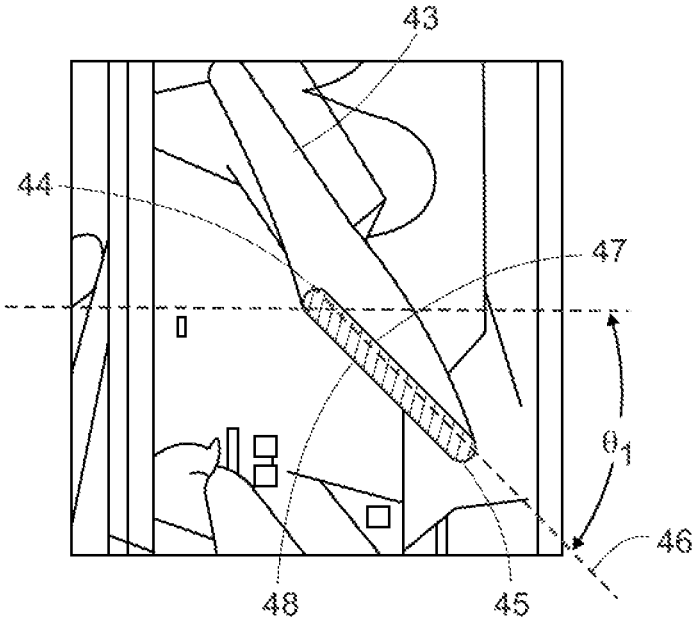
FIG. 6 is an enlarged view of a portion of FIG. 5 as indicated by the reference label "FIG. 6."
Figure 7:
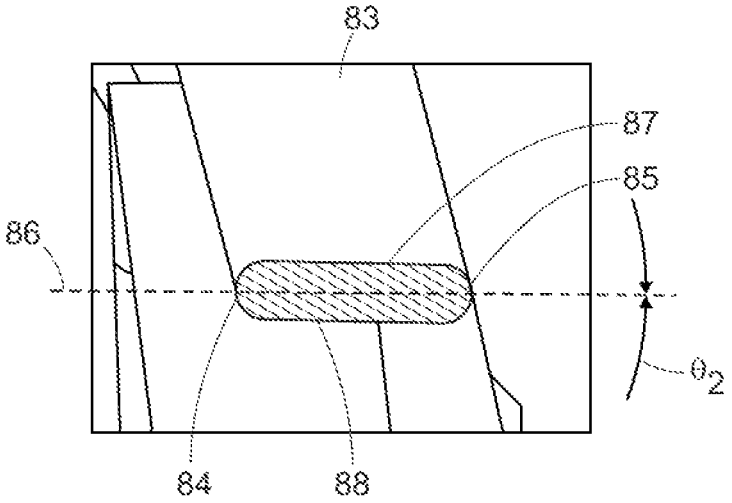
FIG. 7 is an enlarged view of a portion of FIG. 5 as indicated by the reference label "FIG. 7."

Referring to FIGS. 1-4, a fan module 1 of the type used to cool the engine of a motor vehicle includes an air guide 2, a first motor 30 coupled to the air guide 2 via a first shroud 40, and a first axial flow fan 20 coupled to, and driven by, the first motor 30. In addition, the fan module 1 includes a second motor 60 coupled to the air guide 2 via, a second shroud 80, and a second axial flow fan 50 coupled to, and driven by, the second motor 60. In the illustrated embodiment, the first and second motors 30, 60 may be, for example, brushless DC motors. The first and second motors 30, 60 each drive a respective fan 20, 50 about a fan rotational axis 12 that is approximately common to both fans 20, 50. In the fan module 1, the second fan 50 is disposed downstream from the first fan 20 with respect to the direction of airflow through the fan module 1, where the direction of airflow through the fan module 1 is represented by an arrow having reference number 10. The first and second fans 20, 50 are counter-rotating such that the first fan 20 and the second fan 50 rotate in opposite directions. The first and second shrouds 40, 80 include features that improve the efficiency of the fan module 1, as discussed below.

The air guide 2 is configured to be coupled to a heat exchanger (not shown) in a "draw-through" configuration, such that the first and second fans 20, 50 draw an airflow through the heat exchanger. Alternatively, the fan module 1 may be coupled to the heat exchanger in a "push-through" configuration (not shown), such that the first and second fans discharge an airflow through the heat exchanger.

In the illustrated embodiment, the air guide 2 is a molded, one-piece tube that provides an airflow passage between the heat exchanger and the first and second fans 20, 50. The air guide 2 includes a frame portion 4 and a conical portion 6 that protrudes from the frame portion 4. The frame portion 4 has a rectangular profile and is configured to be secured to the heat exchanger via known connection techniques and/or using any of a number of different connectors. The conical portion 6 is generally conical in shape, and includes a first end 8 that is joined to the frame portion 4, and a second end 9 that is spaced apart from the first end 8. The conical portion second end 9 has a smaller diameter than the conical portion first end 8 whereby the conical portion 6 is angled relative to the direction 10 of airflow through the air guide 2. In the illustrated draw-through configuration, the conical portion second end 9 is downstream from the conical portion first end 8 with respect to the direction 10 of airflow through the fan module 1.

The first fan 20 is an axial flow fan that includes a first central hub 22 and first blades 24 that extend radially outwardly from the hub 22. In some embodiments, the first central hub 22 and the first blades 24 are formed as a single piece, for example in an injection molding process. Each first blade 24 includes a first root 26 coupled to the first central hub 22 and a first tip 28 that is spaced apart front the first root 26. The surfaces of each first blade 24 have a complex, three-dimensional curvature that is determined by the requirements of the specific application. The direction of the air flow that is discharged from the first fan 20 is dependent at least in part on the blade curvature, and includes an axial flow component and a tangential flow component. As used herein, the term "axial flow component" refers to a component of air flow that flows in parallel to the direction 10 of air flow through the fan module 1. In the illustrated embodiment, the axial flow component is also parallel to the fan rotational axis 12. As used herein, the term. "tangential flow component" refers to a component of air flow that flows in a direction that is tangential to a circle defined by the rotating first tips 28, and may also be referred to as "swirl."

The first central hub 22 is mechanically connected to the first motor 30 in such a way that the first fan 20 is driven for rotation about the fan rotational axis 12 by the first motor 30, and is supported relative to the air guide 2 by the first motor 30. The first fan 20 rotates about the fan rotational axis 12 in a first direction (represented by an arrow having a reference number 14), for example in a clockwise direction when viewed in a direction 10 parallel to the direction of air flow through the fan module 1.

Similarly, the second fan 50 is an axial flow fan that includes a second central hub 52 and second blades 54 that extend radially outwardly from the second central hub 52. In some embodiments, the second central hub 52 and the second blades 54 are formed as a single piece, for example in an injection molding process. Each second blade 54 includes a second root 56 coupled to the second central hub 52 and a second tip 58 that is spaced apart from the second root 56. The surfaces of each second blade 54 have a complex, three-dimensional curvature that is determined by the requirements of the specific application. The direction of the air flow that is discharged from the second fan 50 is dependent at least in part on the blade curvature. In this counter-rotating arrangement, the second blades 54 are shaped to remove the tangential flow component or swirl imparted to the air flow through the fan module 1 by the first fan 20.

The second central hub 52 is mechanically connected to the second motor 60 in such a way that the second fan 50 is driven for rotation about the fin rotational axis 12 by the second motor 60, and is supported relative to the air guide 2 by the second motor 60. The second fan 50 rotates about the fan rotational axis 12 in a second direction (represented by an arrow having a reference number 16), for example in a counter-clockwise direction when viewed in a direction parallel to the direction 10 of air flow through the fan module 1.

Referring to FIGS. 4-7, the first shroud 40 supports the first motor 30 relative to the air guide 2. The first shroud 40 includes a first barrel 41, a first motor carrier 42 that is spaced apart from, and disposed inwardly relative to, the first barrel 41, and first vanes 43 that extend radially between the first barrel 41 and the first motor carrier 42.

The first barrel 41 is a ring-shaped band, and is configured to be joined to the air guide 2. For example, in some embodiments, an outer surface of the first barrel 41 may include mounting features 49 having through holes (pot shown) that are axially aligned with corresponding openings (not shown) in the conical portion second end 9. Fasteners (not shown) may extend through the through holes of the mounting features 49 and engage with the openings in the conical portion 6, whereby the barrel 41 is secured to the conical portion second end 9. The first barrel 41 may have a double-wall structure that includes an inner wall 32 and an outer wall 33. In some embodiments, the downstream end 34 of the first barrel outer wall 33 may be scalloped. The scallops 35 are formed due to removal of material between the first vanes 43 for the purpose of fan module weight reduction.

The first motor carrier 42 is a generally ring-shaped structure having an outer diameter that is less than a diameter of the first barrel 41 The first motor carrier 42 is concentric with the first barrel 41, and supports the first motor 30. Although the first motor carrier 42 is surrounded by the first barrel 41 in the illustrated embodiment, it is not limited to this configuration. For example, in some embodiments, the first motor carrier 42 may be disposed slightly upstream or downstream from the first barrel 41 with respect to the direction 10 of airflow through the fan module 1. The first motor 30 is supported by the first motor carrier 42 in such a way that the first fan 20 is disposed upstream of the first motor carrier 42 with respect to the direction 10 of air flow through the fan module 1.

The first vanes 43 support the first motor carrier 42 relative to the first barrel 41. To this end, each first vane 43 includes a rounded leading end or nose 44 that faces into, or upstream with respect to, the direction 10 of air flow through the fan module 1, and a rounded trailing end or tail 45 that is opposed to the nose 44 (e.g., faces away front or is downstream with respect to, the direction 10 of air flow through the fan module 1. Each first vane 43 includes opposed air flow surfaces 47, 48 that extend between the nose 44 and the tail 45. When viewed in a cross-section that is obtained by taking a cylindrical section of the first shroud 40 in which the cylinder used to form the section is concentric with the rotation axis of the first fan 20 and passes through the first vanes 43 (see, for example, FIG. 6), the air flow surfaces 47, 48 are linear and parallel to each other. Each first vane is a thin beam in that the distance between the air flow surfaces 47, 48 is small relative to a distance between the nose 44 and the tail 45.

Each first vane 43 is at an angle θ1 (e.g., is at a non-zero angle) relative to the fan rotational axis 12. In particular, a first line 46 that extends between the nose 44 and the tail 45, and is parallel to the air flow surfaces 47, 48, is at an angle θ1 (e.g., at a non-zero angle) relative to the fan rotational axis 12. More specifically, the first line 46 corresponds to the longest straight line that can be drawn through the cylindrical cross section of the first vane 43.

The specific angle θ1 that is used is determined by the requirements of the specific application. In the some embodiments, each first vane 43 is designed to be aligned with the air flow leaving the first fan 20 at all radii. In other words, the angle θ1 is set so that the first line 46 is aligned with the an flow exiting the first fan 20. By aligning the first line 46 with the tangential component of the air flow exiting the first fan 20, the disruptive effect of the presence of the first vanes 43 in the path of the air flow is minimized (e.g., air flow losses are minimized). Since the air flow leaves the first fan 20 at an angle that varies from blade root 26 to blade tip 28, for each vane 43, the angle θ1 varies from the first vane inner end 37 to the first vane outer end 39. In the illustrated embodiment, for a given radius, the first vane 46 is at an acute angle, such as a 45 degree angle, relative to the fan rotational axis 12.

The second shroud 80 supports the second motor 60 relative to the air guide 2. The second shroud 80 includes a second barrel 81, a second motor carrier 82 that is spaced apart from, and disposed inwardly relative to, the second barrel 81, and second vanes 83 that extend radially between the second barrel 81 and the second motor carrier 82.

The second barrel 81 is a ring-shaped band, and is configured to be joined to the downstream end of the first barrel 41. For example, in some embodiments, an outer surface of the second barrel 81 may include mounting features 89 that align with corresponding mounting features 49 provided on the outer surface of the first barrel 41. The mounting features 89 of the second barrel 81 include through holes, and the fasteners may extend through the through holes of the mounting features 49, 89 of both the first and second barrels 41, 81 and engage with the openings in the conical portion 6, whereby the barrel 41 is secured to the conical portion second end 9.

The second barrel 81 may have a double-wall structure that includes an inner wall 62 and an outer wall 63. In some embodiments, the downstream ends 64 of the second barrel inner wall 62 and outer wall 63 may be scalloped. The scallops 65 are formed due to removal of material between the second vanes 83 for the purpose of fan module weight reduction.

The upstream end 66 of the second barrel 81 may include a collar 68 that protrudes axially toward the first barrel 41. The collar 68 is dimensioned to correspond to an outer diameter of the first barrel inner wall 32, and is received within space between the first barrel inner and outer walls 32, 33 when the second barrel 81 is assembled with the inner barrel 41. The collar 68 serves to locate the second barrel 81 with respect to the first barrel 41, and also facilitates an air-tight joint between the first and second barrels 41, 81.

The second motor carrier 82 is a generally ring-shaped structure having an outer diameter that is less than a diameter of the second barrel 81 The second motor carrier 82 is concentric with the second barrel 81, and supports the second motor 60. In the illustrated embodiment, the second motor carrier 82 is surrounded by the second barrel 81, but is not limited to this configuration. For example, in some embodiments, the second motor carrier 82 may be disposed slightly upstream or downstream from the second barrel 81 with respect to the direction 10 of airflow through the fan module 1. The second motor 60 is supported by the second motor carrier 82 in such a way that the second fan 50 is disposed upstream of the second motor carrier 82 with respect to the direction 10 of air flow through the fan module 1.

The second vanes 83 support the second motor carrier 82 relative to the second barrel 81. To this end, each second vane 83 includes a rounded leading end or nose 84 that faces into, or upstream with respect to, the direction 10 of air flow through the fan module 1, and a rounded trailing end or tail 85 that is opposed to the nose 84 (e.g., faces away from, or downstream with respect to, the direction 10 of air flow through the fan module 1. Each second vane 83 includes opposed air flow surfaces 87, 88 that extend between the nose 84 and the tail 85. When viewed in a cross-section obtained by taking a cylindrical section of the second shroud 80 in which the cylinder used to form the section is concentric with the rotation axis of the second fan 50 and passes through the second vanes 83 (see, for example, FIG. 7), the air flow surfaces 87, 88 are linear and parallel to each other. Each second vane 83 is a thin beam in that the distance between the air flow surfaces 87, 88 is small relative to a distance between the nose 84 and the tail 85.

Each second vane 83 is parallel to the fan rotational axis 12. In particular, a second line 86 that extends between the nose 84 and the tail 85, and is parallel to the air flow surfaces 87, 88, is set at an angle θ2 relative to the fan rotational axis 12. More specifically, the second line 86 corresponds to the longest straight line that can be drawn through the cylindrical cross section of the second vane 83. The angle θ2 of the second line 86 is oriented so as to match the direction of air flow exiting the second fan 50 at all radii. Since the tangential component of air flow is removed from the overall air flow by the shape of the blades 54 of the second fan 50, the second line 86 is set as parallel to the fan rotational axis 12 (e.g., angle θ2 is approximately zero) for all radii. It is understood that, in use, the second line 86 and the fan rotational axis 12 may not be precisely parallel. In some embodiments, the term "approximately zero" is used to indicate that the second line 86 is parallel to the fan rotational axis 12 within twelve degrees. In other embodiments, the term "approximately zero" is used to indicate that the second line 86 is parallel to the fan rotational axis 12 within six degrees. In still other embodiments, the term "approximately zero" is used herein to indicate that the second line 86 is parallel to the fan rotational axis 12 within three degrees.

When the fan module 1 is in use, air enters the first fan 20 in a direction that is parallel with the fan rotational axis 12. The first fan 20 introduces swirl within the air guide 2. That is, the air flow leaving the first fan 20 includes a component of flow that travels in a tangential direction relative to the fan rotational axis 12. The swirl has the same direction as the rotation of the first fan 20.

The air leaving the first fan 20 passes through the first vanes 43, which are downstream with respect to the first fan 20. The first vanes 43 are set at an angle substantially aligned with the swirl of the air passing through, so as to present minimum resistance to the air flow at this location.

After exiting the first fan 20 and the first shroud 40, the flow of air, including the swirl imparted by the first fan 20, enters the second fan 50. The second fan 50 applies a swirl (e.g., a "counter-swirl") to the flow in the opposite direction. The counter swirl imparted by the second fan 50 substantially counteracts the swirl introduced by the first fan 20. As a result, the air flow leaving the second fan 50 is substantially parallel with the fan rotational axis.

The air leaving the second fan 50 passes through the second vanes 83. The second vanes 83 are set at an angle substantially aligned with the rotational axis of the second fan 50, so as to present minimum resistance to the air flow.

Figure 8:
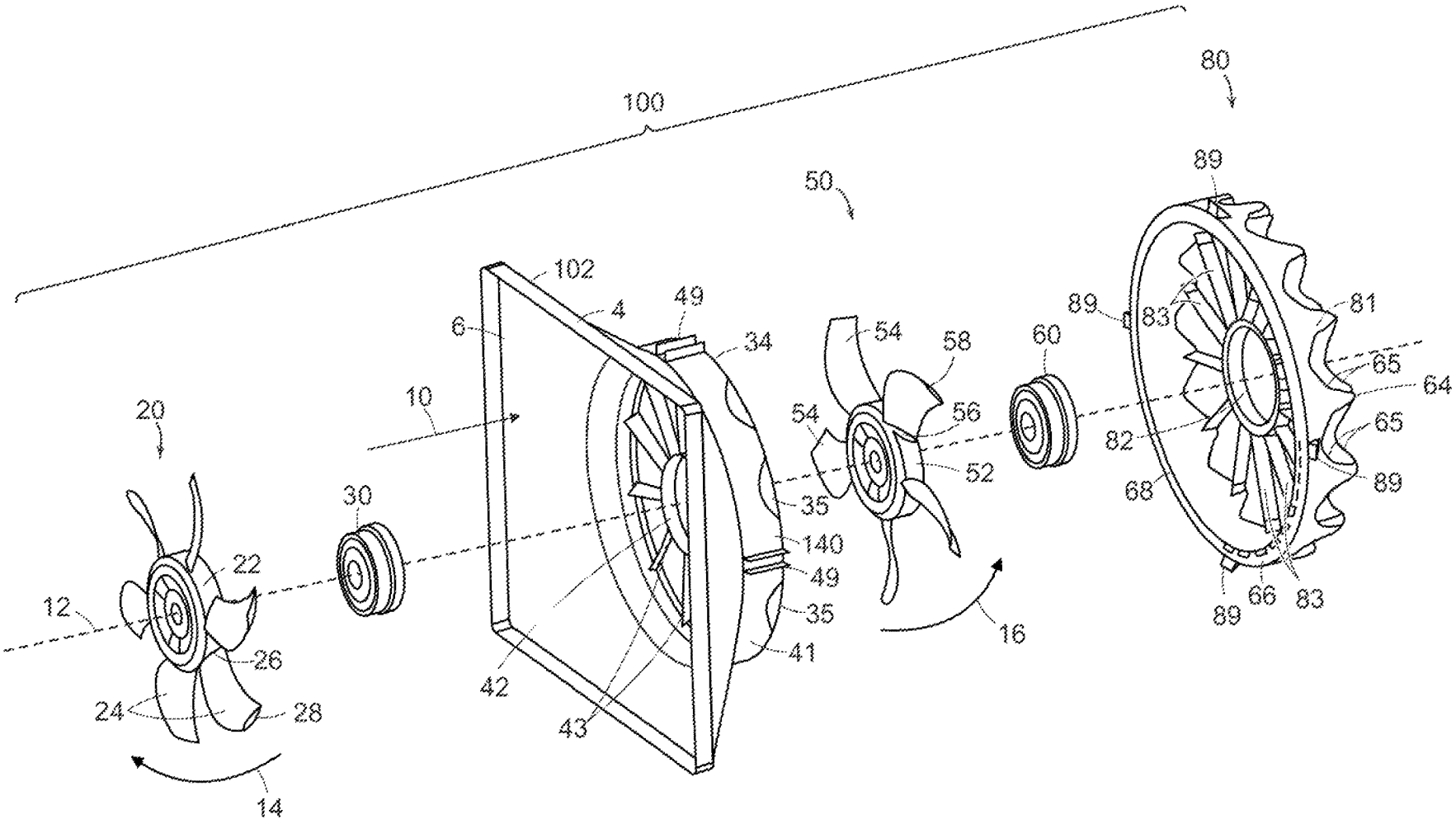
FIG. 8 is an exploded view of an alternative embodiment fan module.

Referring to FIG. 8, an alternative embodiment fan module 100 is similar to the fan module 1 described above with respect to FIGS. 1-4, and common reference numbers are used to refer to common elements. The fan module 100 shown in FIG. 8 differs from the fan module 1 described above with respect to FIGS. 1-7 in that the fan module 100 includes a modified air guide 102. Like the air guide 2 of the previous embodiment, the modified air guide 102 includes the frame portion 4 and the conical portion 6 that extends from the frame portion 4. In addition, the modified air guide 102 includes the first shroud 140 formed integrally with the conical portion 6 so as to protrude from the conical portion second end 9. By forming the first shroud 140 and the air guide 102 as a single piece, the number of parts and assembly costs are reduced. In the fan module 100, the second shroud 80 is secured to the downstream end 34 of the first barrel 41.

Although the first and second shrouds include the motor carriers 42, 82 and the barrels 41, 81 that are generally circular in profile, the motor carriers 42, 82 and the bands 41, 81 are not limited to having a generally circular profile. For example, the motor carriers 42, 82 may be shaped and dimensioned to accommodate the respective motors 30, 60, and the barrels 41, 81 may be shaped and dimensioned to accommodate the shape and dimensions of a portion of the inner surface of the air guide 2. Moreover, in some embodiments, the motor carriers 42, 82 may not have the same shape as the barrels 41, 81, and/or the motor carriers 42, 82 may not be concentric with the barrels 41, 81.

Although in the illustrated embodiment, the air flow surfaces 47, 48, 87, 88 of the vanes 43, 83, when viewed in cross-section, are linear and parallel to each other, the vanes 43, 83 are not limited to this configuration. The cross-sectional shape of the vanes 43, 83 is determined by the requirements of the specific application.

Selective illustrative embodiments of the fan module are described above in some detail. It should be understood that only structures considered necessary for clarifying the fan module have been described herein. Other conventional structures, and those of ancillary and auxiliary components of the fan module, are assumed to be known and understood by those skilled in the art. Moreover, while a working example of the fan module has been described above, the fan module is not limited to the working example described above, but various design alterations may be carried out without departing from the fan module as set forth in the claims.

I claim:

1. A fan module for an automotive cooling system, the fan module comprising:

a first fan that is configured to rotate about a fan rotational axis;

a second fan that is configured to rotate about a second axis, the second fan disposed downstream of the first fan with respect to the direction of airflow through the fan module, the second axis being approximately common with the fan rotational axis;

a first motor configured to drive the first fan to rotate about the fan rotational axis in a first direction;

a second motor configured to drive the second fan to rotate about the second axis in a second direction, the second direction being opposed to the first direction;

a first shroud that supports the first motor, the first shroud comprising a first barrel that surrounds the fan rotational axis, a first motor carrier that is disposed inwardly with respect to the first barrel, and first vanes that extend between the first barrel and the first motor carrier; and a second shroud that supports the second motor, the second shroud comprising a second barrel that surrounds the fan rotational axis, a second motor carrier that is disposed inwardly with respect to the second barrel, and second vanes that extend between the second barrel and the second motor carrier, wherein the first motor is supported by the first motor carrier, the second motor is supported by the second motor carrier, the first motor carrier is disposed downstream from the first fan with respect to the direction of air flow through the fan module, the second motor carrier is disposed downstream from the second fan with respect to the direction of air flow through the fan module, each first vane has a first nose that faces the direction of air flow through the fan module, and a first tail that is opposed to the first nose, and a first line that extends between the first nose and the first tail is angled at a first angle relative to the fan rotational axis, each second vane has a second nose that faces the direction of air flow through the fan module, and a second tail that is opposed to the second nose, and a second line that extends between the second nose and the second tail is angled at a second angle relative to the second axis, the second angle is different than the first angle, the first angle is aligned with air flow discharged from the first fan, and the second angle is approximately zero.

2. The fan module of claim 1, wherein the first angle is a non-zero angle.

3. The fan module of claim 1, wherein the second line is parallel to the second axis.

4. The fan module of claim 1, comprising an air guide that supports the first shroud and is configured to provide an air flow passage between the first fan and a heat exchanger, and wherein the second shroud is supported on the first shroud.

5. The fan module of claim 4, wherein the first shroud is integral with the air guide.

6. The fan module of claim 1, wherein the first vane comprises opposed first air flow surfaces that extend between the first nose and the first tail, and the distance between the respective first air flow surfaces is small relative to a distance between the first nose and the first tail, and the second vane comprises opposed second air flow surfaces that extend between the second nose and the second tail, and the distance between the respective second air flow surfaces is small relative to a distance between the second nose and second tail.

7. An automotive cooling system comprising a heat exchanger and a fan module configured to draw air through the heat exchanger, wherein the fan module comprises:

a first fan that is configured to rotate about a fan rotational axis;

a second fan that is configured to rotate about a second axis, the second fan disposed downstream of the first fan with respect to the direction of airflow through the fan module, the second axis being approximately common with the fan rotational axis;

a first motor configured to drive the first fan to rotate about the fan rotational axis in a first direction;

a second motor configured to drive the second fan to rotate about the second axis in a second direction, where the second direction is opposed to the first direction;

a first shroud that supports the first motor, the first shroud comprising a first barrel that surrounds the fan rotational axis, a first motor carrier that is disposed inwardly with respect to the first barrel, and a first vane that extends between the first barrel and the first motor carrier; and a second shroud that supports the second motor, the second shroud comprising a second barrel that surrounds the fan rotational axis, a second motor carrier that is disposed inwardly with respect to the second barrel, and a second vane that extends between the second barrel and the second motor carrier, wherein the first motor is supported by the first motor carrier, the second motor is supported by the second motor carrier, the first motor carrier is disposed downstream from the first fan with respect to the direction of air flow through the fan module, the second motor carrier is disposed downstream from the second fan with respect to the direction of air flow through the fan module, the first vane has a first nose that faces the direction of air flow the fan module, and a first tail that is opposed to the first nose, and a first line that extends between the first nose and the first tail is angled at a first angle relative to the fan rotational axis, the second vane has a second nose that faces the direction of air flow through the fan module, and a second tail that is opposed to the second nose, and a second line that extends between the second nose and the second tail is angled at a second angle relative to the second axis, the second angle is different than the first angle, the first angle is aligned with air flow discharged from the first fan, and the second angle is approximately zero.

8. The cooling system of claim 7, wherein the first angle is a non-zero angle.

9. The cooling system of claim 7, wherein the second line is parallel to the second axis.

10. The cooling system of claim 7, comprising an air guide that supports the first shroud and is configured to provide an air flow passage between the first fan and a heat exchanger, and wherein the second shroud is supported on the first shroud.

11. The cooling system of claim 10, wherein the first shroud is integral with the air guide.

12. The cooling system of claim 7, wherein the first vane comprises opposed first air flow surfaces that extend between the first nose and the first tail, and the distance between the respective first air flow surfaces is small relative to a distance between the first nose and the first tail, and the second vane comprises opposed second air flow surfaces that extend between the second nose and the second tail, and the distance between the respective second air flow surfaces is small relative to a distance between the second nose and second tail.

13. A method of manufacturing a fan module for a vehicle, the fan module comprising:

a first fan;

a first motor configured to drive the first fan to rotate about a fan rotational axis in a first direction;

a first shroud that supports the first motor relative to the first fan via a first motor carrier that is disposed downstream of the first fan with respect to the direction of air flow through the fan module;

a second fan, the second fan disposed downstream of the first fan with respect to the direction of airflow through the fan module;

a second motor configured to drive the second fan to rotate about a second axis in a second direction, where the second direction is opposed to the first direction and the second axis is approximately common with the fan rotational axis;

a second shroud that supports the second motor relative to the second fan via a second motor carrier that is disposed downstream of the second fan with respect to the direction of air flow through the fan module;

the first shroud comprises a first barrel that surrounds the fan rotational axis, the first motor carrier that is disposed inwardly with respect to the first barrel, and first vanes that extend between the first barrel and the first motor carrier; and the second shroud comprises a second barrel that surrounds the fan rotational axis, the second motor carrier that is disposed inwardly with respect to the second barrel, and second vanes that extend between the second barrel and the second motor carrier, wherein each first vane has a first nose that faces the direction of air flow through the fan module, and a first tail that is opposed to the first nose, and a first line that extends between the first nose and the first tail is angled at a first angle relative to the fan rotational axis, each second vane has a second nose that faces the direction of air flow through the fan module, and a second tail that is opposed to the second nose, and a second line that extends between the second nose and the second tail is angled at a second angle relative to the second axis, the second angle is different than the first angle, the first angle is aligned with air flow discharged from the first fan, and the second angle is approximately zero, and wherein the method comprises assembling a first subassembly that includes the first fan, the first shroud, the first motor carrier and the first motor;

assembling a second subassembly that includes the second fan, the second shroud, the second motor carrier and the second motor, and assembling the first sub assembly with the second subassembly to provide a third subassembly in which the second fan is disposed downstream relative to the first fan with respect to a direction of air flow through the first fan.

14. The method of claim 13, wherein the fan module comprises an air guide, and the method includes assembling the third subassembly with the air guide.

15. The method of claim 13, wherein, the first shroud is integrally formed with an air guide, and the method step of assembling the first sub assembly with the second subassembly to provide a third subassembly includes securing the second subassembly to an end of the first shroud.

* * * * *